US005327689A

United States Patent [19]

Jansen

[11] Patent Number: 5,327,689

[45] Date of Patent: Jul. 12, 1994

[54] GUTTER AND IMPROVED GUTTER INSTALLATION SYSTEMS

[75] Inventor: James M. Jansen, South Australia, Australia

[73] Assignee: Stratco Metal Proprietary Limited, Gepps Cross, Australia

[21] Appl. No.: 867,816

[22] Filed: Apr. 13, 1992

[30] Foreign Application Priority Data

Apr. 12, 1991 [AU] Australia ..... PK5562.

[51] Int. Cl.[5] ..... E04D 13/06

[52] U.S. Cl. ..... 52/11; 248/48.2

[58] Field of Search ..... 52/14, 15, 16, 11, 12; 248/48.1, 48.2

[56] References Cited

U.S. PATENT DOCUMENTS

| | | | |
|---|---|---|---|
| 178,359 | 6/1876 | Conklin | 52/11 |
| 559,942 | 5/1896 | Horan | 52/11 |
| 3,222,828 | 12/1965 | Kvan | 52/11 |
| 3,670,505 | 6/1972 | Weaver | 52/12 |
| 4,043,527 | 8/1977 | Franzmeier | 52/11 |
| 4,553,357 | 11/1985 | Pepper | 52/12 |
| 4,741,645 | 5/1988 | Butler | 52/11 |

FOREIGN PATENT DOCUMENTS

| | | | |
|---|---|---|---|
| 852417 | 9/1970 | Canada | 52/16 |
| 1484061 | 12/1968 | Fed. Rep. of Germany | 52/15 |
| 1338495 | 8/1963 | France | 52/12 |
| 1384059 | 11/1964 | France | 248/48.2 |
| 1105069 | 3/1968 | United Kingdom | 52/16 |

*Primary Examiner*—Michael Safavi

*Attorney, Agent, or Firm*—Edward W. Callan

[57] ABSTRACT

This invention relates to the construction of a gutter 10 for the draining of fluid, where a portion of the gutter is formed from continuous lengths of polymeric strip-like material 11. The strip like material comprises a continuously extruded thin strip of polymeric material 11 which is sufficiently resilient to allow flexing of the strip 11 about its longitudinal axis to form a substantially U shaped cross-section along its length. A plurality of brackets 18 are provided for holding a length of the flexed strip 11. The brackets 18 secure the gutter 10 to a structure and comprise a first portion 20 for securing the bracket 18 to a structure, a recess 23 for location of the flexed strip 11 therein and means 26, 27 for securing the flexed strip 11 within the recess of the bracket 18. The invention provides a convenient means of installing continuous lengths of gutter to a roof while minimizing material wastage and construction time.

6 Claims, 5 Drawing Sheets

GUTTER AND IMPROVED GUTTER INSTALLATION SYSTEMS

This invention relates to installation of gutter systems, and in particular to an improved gutter.

Obviously, there is a need to simplify componentry associated with gutter installations, and in addition there is a need to simplify the actual installation of gutters and gutter componentry.

In the past, gutters have normally comprised finite lengths of rollformed channel section. However the use of fixed length gutters requires the formation of joins at various intervals. This is undesirable due to the possibility of leakage, and in addition there is an unacceptable amount of material wastage in relation to off cuts.

In order to overcome this problem, rollforming equipment has been produced which can manufacture continuous lengths of metal gutter channel at a building site. This obviously overcomes the problems associated with joins and off cut wastage, but represents a considerable capital expenditure, which cannot be continuously operating if it is travelling from site to site.

Therefore, it is an aspect of this invention to provide a gutter which can be produced in continuous lengths and installed with a minimum number of joins and with minimum wastage through unnecessary off cuts, without the need for on site manufacturing or rollforming machines.

In existing gutter installations, it is common to secure gutters to barge boards using gutter straps. The barge boards, and other fittings are necessary to provide a pleasing appearance, but obviously increase the cost considerably.

In order to overcome this problem, it is known to make use of fascia panels which are secured to brackets which are nailed to roof rafters. However, the use of such fascia panels still involves securing gutters to the external surface of the fascia panel.

Therefore, it is a further object of this invention to provide a means whereby continuous lengths of gutter can be used in association with a decorative fascia panel. provides a gutter formed from continuous strip-like material, comprising a continuously extruded thin strip of polymeric material, said strip formed by an extrusion process with a U-shaped cross-section and being resilient enough to allow said strip to be both flattened and wound onto a roll for storage prior to use, and flexed about its longitudinal axis into a U-shaped cross-section when unwound, and a plurality of spaced brackets each having a recess in which said flexed strip is supported and each having means for securing said flexed strip within said recess, said gutter being formed by cutting a required length of said strip, placing said cut length of strip over said brackets, flexing said cut strip so as to locate it within said recess of each said bracket, and securing said cut strip to each of said brackets, wherein a beading is formed along each longitudinal edge of said strip, said beading being shaped to have a surface which extends outwardly with respect to the central longitudinal axis of said flexed strip so as to direct any overflowing fluid away from the outer surface of said flexed strip.

In another aspect, this invention provides a gutter formed from continuous strip-like material, comprising a continuously extruded thin strip of polymeric material, said strip formed by an extrusion process with a U-shaped cross-section and being resilient enough to allow said strip to be both flattened and wound onto a roll for storage prior to use, and flexed about its longitudinal axis into a U-shaped cross-section when unwound, and a plurality of spaced brackets each having a recess in which said flexed strip is supported and each having means for securing said flexed strip within said recess, said gutter being formed by cutting a required length of said strip, placing said cut length of strip over said brackets, flexing said cut strip so as to locate it within said recess of each said bracket, and securing said cut strip to each of said brackets, wherein the brackets are adapted for being secured to a structure, wherein said recess in the bracket is substantially U-shaped, and wherein the means for securing said flexed strip within the recess comprise means for securing each longitudinal edge of said flexed strip so that when the brackets are secured to said structure, a longitudinal inner edge of the flexed strip in relation to said structure is held in a position that is higher than the an opposing outer longitudinal edge of the flexed strip, wherein said means for securing the flexed strip further comprises a first means for fixedly securing the inner edge of said flexed strip which is closes to said structure, and a second means for adjustably holding the outer edge of said flexed strip, said second means having a plurality of fixing points to allow the vertical position of the base of the flexed strip to be varied.

In still another aspect, this invention provides a gutter formed from continuous strip-like material, comprising a continuously extruded thin strip of polymeric material, said strip formed by an extrusion process with a U-shaped cross-section and being resilient enough to allow said strip to be both flattened and wound onto a roll for storage prior to use, and flexed about its longitudinal axis into a U-shaped cross-section when unwound, and a plurality of spaced brackets each having a recess in which said flexed strip is supported and each having means for securing said flexed strip within said recess, said gutter being formed by cutting a required length of said strip, placing said cut length of strip over said brackets, flexing said cut strip so as to locate it within said recess of each said bracket, and securing said cut strip to each of said brackets, wherein the brackets are adapted for being secured to a structure, the gutter further comprising an overflow portion formed in an outer edge of the flexed strip in relation to said structure when the brackets are secured to said structure, said overflow portion comprising a perforate section of said outer edge, and an elongate spout formed below the perforate section on an outer surface of the flexed strip to direct overflowing fluid away from the outer surface of the flexed strip. The action of flattening the section when winding the strip will result in the strip returning only to a partial U-shaped cross-section when unwound. Only a minor amount of flexing will then be required to form a U-shaped cross-section.

Preferably, beading is formed along each longitudinal edge of the gutter, wherein the beading is shaped to have a surface which extends outwardly with respect to the central longitudinal axis of the flexed strip so as to direct any overflowing fluid away from the outer surface of the flexed strip. The beading also assists torsional strength and ease of installation.

Preferably, as the gutter is being extruded, it is also wound onto a drum in a substantially flat position for storage or transport. On site, the gutter can be unwound, and cut to the desired length ready for installation.

Fittings such as end caps, mitre joints, down pipe fittings and other such devices are designed to be connected to the gutter to enable installation around any structure such as a house.

Preferably, the means for securing the flexed strip within the bracket allows the strip to be pushed into the recess, and securely held when in place.

Preferably the recess in the bracket is substantially U-shaped so as to conform to the shape of the flexed strip. Further, the recess may be provided with means for securing each edge of the flexed strip, so that the inner edge is held in a position that is higher than the outer edge of the flexed strip to ensure that any fluid overflow occurs over the outer edge.

A first securing means may be provided for securing the inner edge, and a second means, having a plurality of fixing points, may be provided for securing the outer edge. The plurality of fixing points allow the height of the base of the flexed strip to be adjusted so as to adjust the fall of the gutter.

The first and second securing means may comprise an arm extending into the recess which is dependent and spaced from the bracket which allows the upward insertion of either the inner or outer edge of the flexed strip between the bracket and arm. A tab in the case of the first means, and a plurality of tabs in the case of the second means, project from the bracket. They allow the beading on each edge to pass, but resist withdrawal by locating under the beading.

In order to fully understand the invention, preferred embodiments will now be described, but it should be realised that the scope of the invention is not to be restricted or limited to any of the features described in these embodiments.

These embodiments are illustrated in:

FIGS. 1*a*, 1*b* and 1*c* show cross-sectional views of the strip used to form the gutter, where FIG. 1*a* shows the extruded form prior to rolling into a coil, FIG. 1*b* shows the section flattened when rolled into a coil and FIG. 1*c* shows the shape that the strip assumes when uncoiled;

Figure 1A:
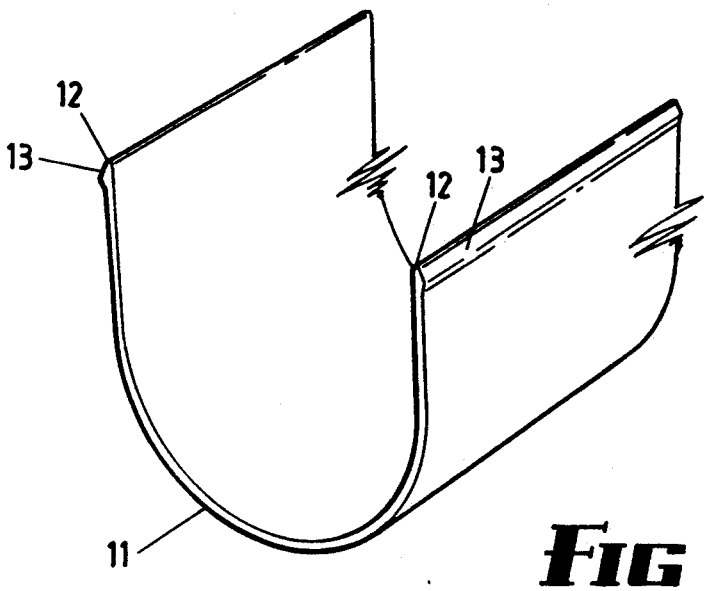
Figure 1B:
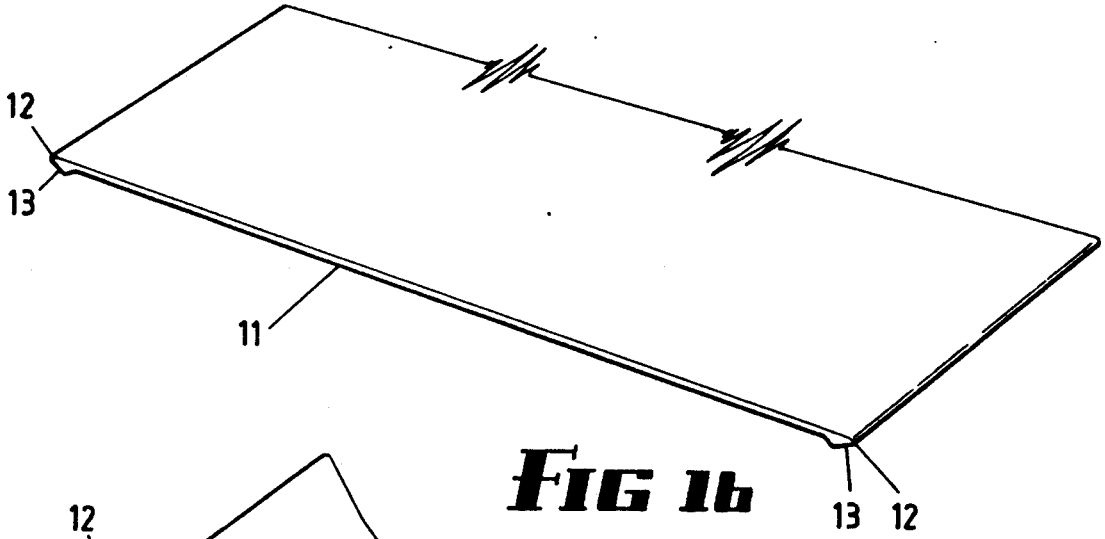
Figure 1C:
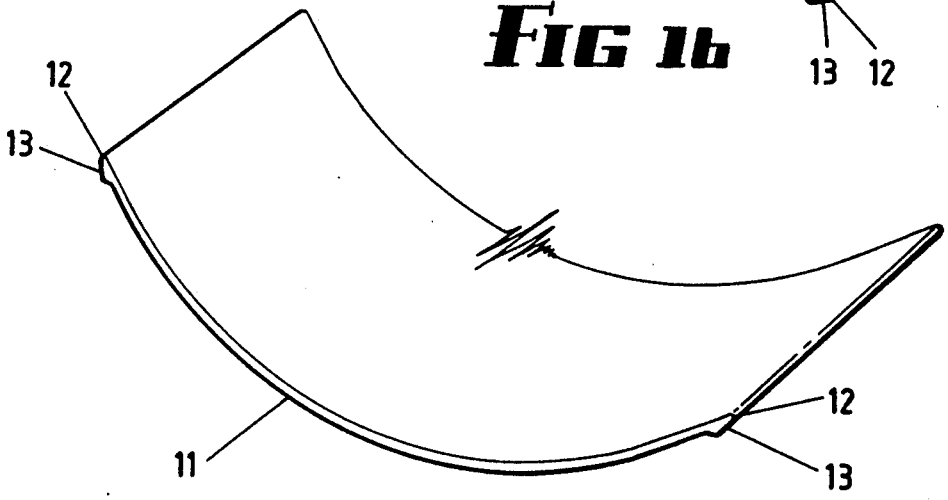
Figure 6:
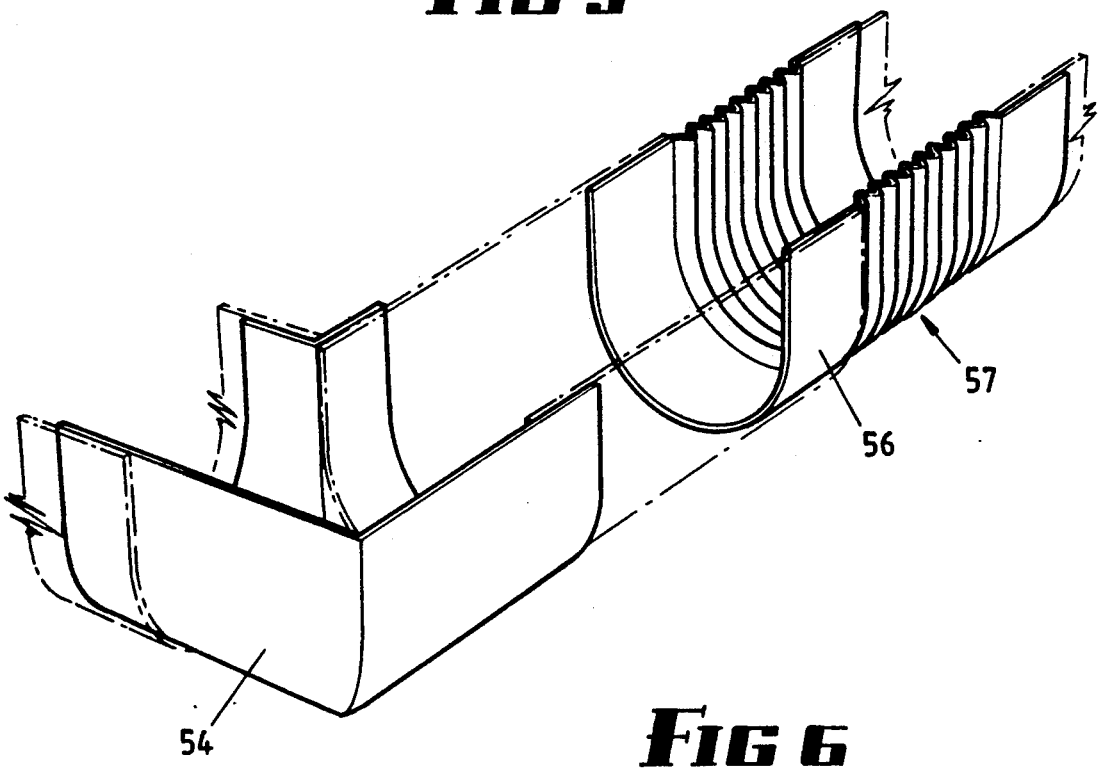

FIG. 6 shows a longitudinally flexible section and an elbow connection. FIG. 1*c* shows the cross-sectional view of the strip 11 when uncoiled which is used to produce the gutter 10. As can be seen in this illustration, the strip 11 comprises a thin walled extrusion which is initially produced with a U-shaped cross-section as shown in FIG. 1*a*, which is then flattened for coiling as shown in FIG. 1*b* . The material used to produce the strip 11 is uPVC plastic. Further, beading 12 is formed on each edge of the strip 11, the beading 12 being shaped to have a surface 13 which is arranged such that when the strip 11 is flexed about its longitudinal axis so as to form a substantially U-shaped cross section, the surfaces 13 extend outwardly with respect to the central longitudinal axis so as to direct any overflowing fluid away from the outer surface 15 of the flexed strip 11.

The main advantage of the strip 11 is that it can be stored on a roll prior to use. This enables the required length of strip 11 to be cut at a building site which then results in reduced wastage and increased efficiency. In addition, the storage space required, and transportation costs can be significantly reduced.

Figure 2:
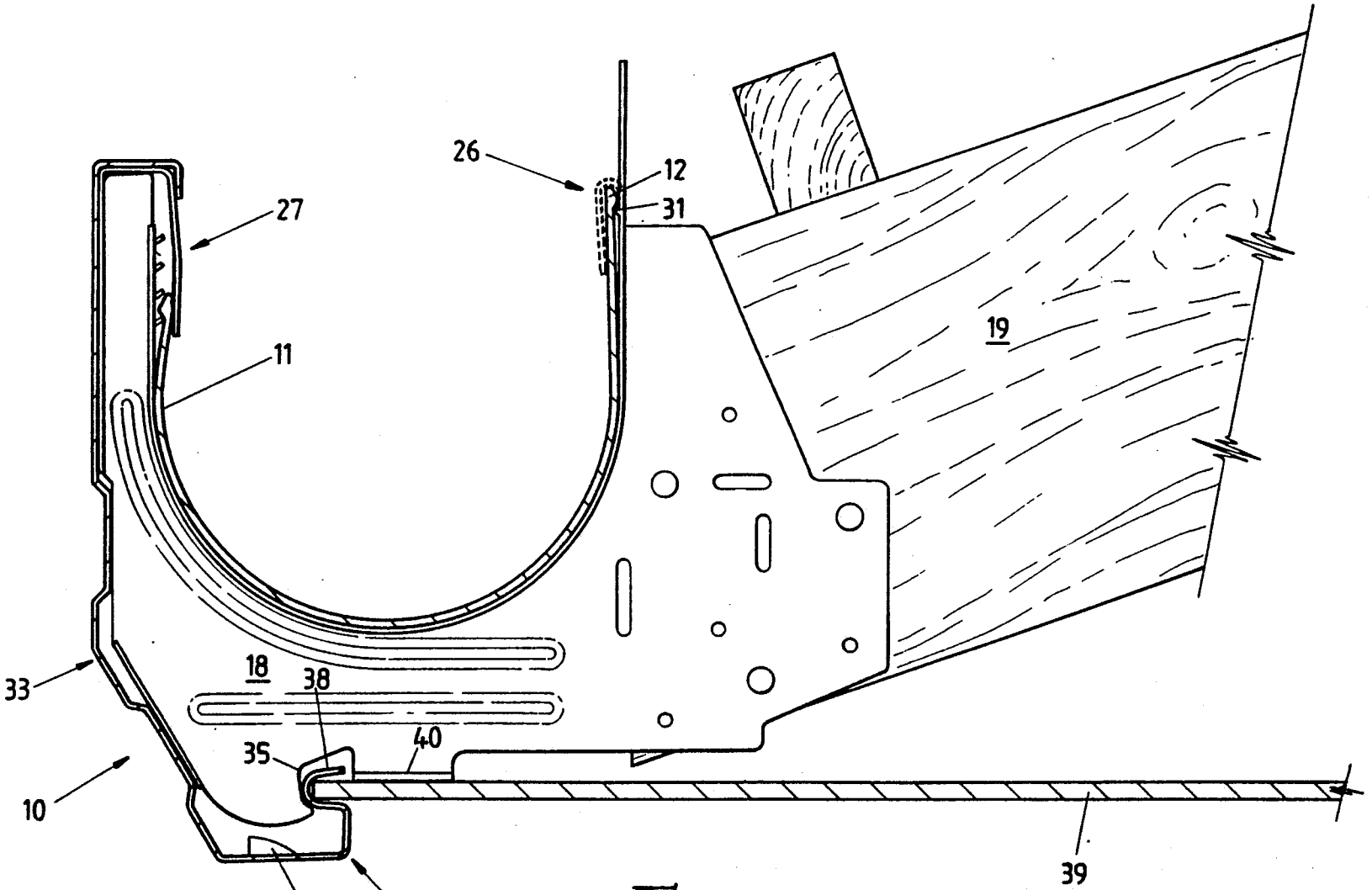
FIG. 2 shows a bracket fixed to a rafter with a gutter located within the bracket.

FIG. 2 shows the assembled gutter 10 which includes the strip 11 in its flexed form and a bracket 18. The bracket 18 is pressed from light gauge metal, and is secured to a side of a rafter 19.

Figure 3:
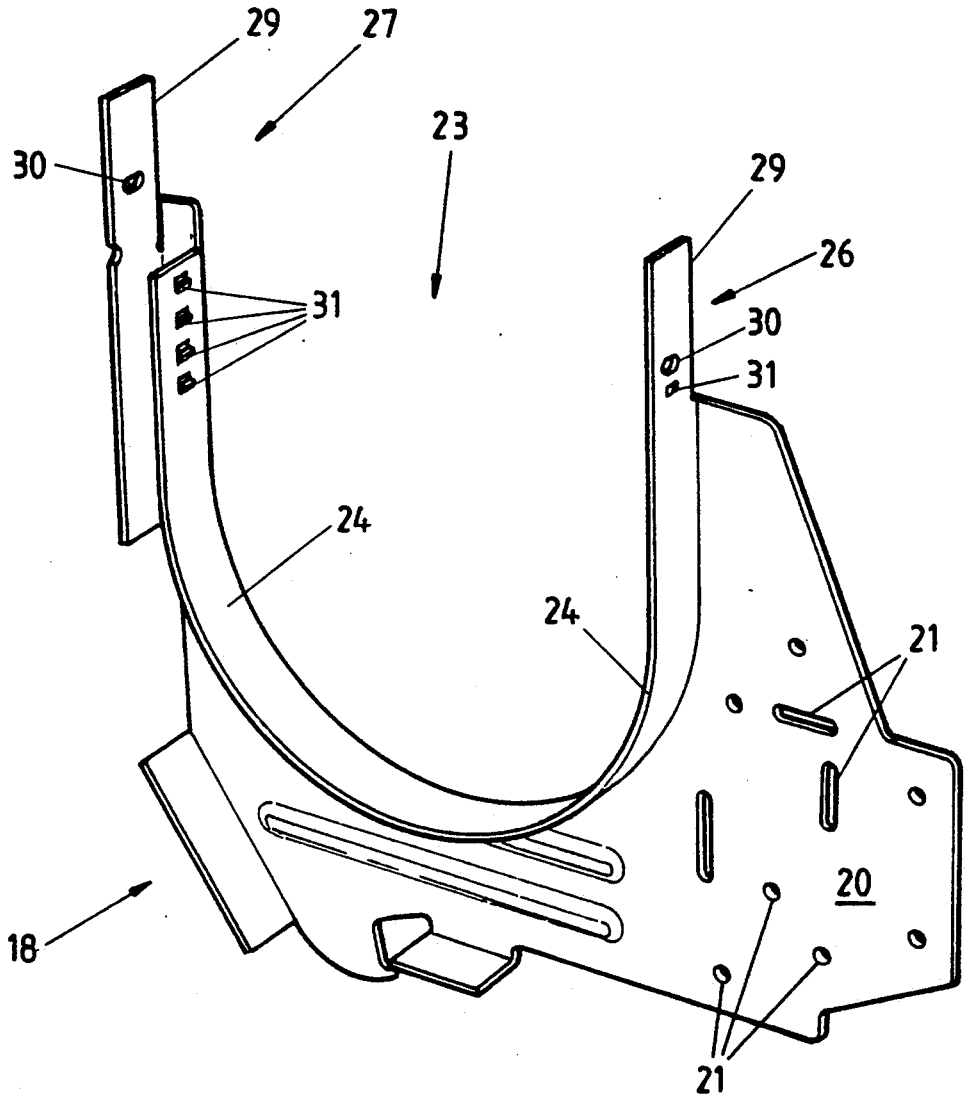
FIG. 3 shows a perspective view of the bracket.

The bracket prior to installation on the rafter 19 is shown in FIG. 3, and comprises a means for securing the bracket 18 to a structure such as a rafter 19, which comprises a plate portion 20 which has a plurality of apertures 21 for securement of the bracket 18 to a rafter 19 by the use of nails or threaded fasteners.

Further, the bracket 18 is provided with a recess 23 within which the flexed strip locates. A flange 24 is provided within the recess 23, and provides a broad surface against which the flexed strip 11 may abut.

Finally, the bracket 18 is provided with means for securing the flexed strip within the recess 23, and in this embodiment comprise a first means 26 for securing the inner edge of the flexed strip 11 and a second means 27 for securing the outer edge of the flexed strip 11.

As seen in FIG. 3, both the first and second securing means 26 and 27 comprise an arm 29 which can be bent into the recess 23, To assist bending of each arm 29, an aperture 30 is provided, which produces an area of weakness in each arm 29 which will cause bending to be initiated at the location of the aperture 30. Tabs 31 are pressed out of the flange 24, and as can be seen in both FIGS. 2 and 3, the first securement means 26 is provided with a single tab 31, and the second securement means 27 is provided with a plurality of tabs 31.

As shown in FIG. 2, the beading 12 locates over the respective tab 31 and the arm 29 is then bent over the respective edge of the strip 11. Alternatively, the arm 29 may be pre-bent, which allows the upward insertion of the respective edge of the flexed strip 11 between the bracket flange 24 and the arm 29. The arm 29 may be bent to such an extend which allows the beading 12 to pass the tab 31, and once the beading 12 is positioned so that it engages the tab 31, the arm is further bent so that the engagement of the beading 12 on the tab 31 resists withdrawal of the respective edge of the flexed strip 11.

The provision of a plurality of tabs 31 on the second securing means 27 enables the outer edge of the flexed strip 11 to be positioned at various heights. This allows the fall of the gutter 10 to be adjusted to provide proper drainage from an installed gutter 10.

Generally, as seen in FIG. 2, the inner edge of the flexed strip 11 is positioned so that it is always higher than the outer edge of the flexed strip 11. This ensures that if blockage occurs and overflow results, then the overflow will occur over the outer edge of the flexed strip 11 rather than overflowing over the inner edge thereby resulting in water flowing into the eaves section of the roof.

As seen in FIG. 2, the bracket 18 is arranged to have a fascia panel 33 secured thereto. The upper edge of the fascia panel 33 locates over the second securing means 27 and the lower edge of the fascia panel 33 locates within a notch 35 on the bracket 18. This arrangement allows continuous lengths of fascia panel 33 to be secured to a plurality of brackets 18 which are located at spaced intervals along a roof line.

The lower edge 37 of the fascia panel 33 is provided with a channel 38 for location of a soffit panel 39 therein. In addition, the bracket 18 is provided with a tab 40 which by use of a threaded fastener or other means may be secured to the soffit panel 39.

Slots 41 are pressed into the fascia panel 33 to provide the drainage and ventilation apertures. If the gutter 10 overflows, then water will flow over the outer edge of the flexed strip 11 and the water will be directed towards the inner face of the fascia panel 33 and will then flow towards the drainage slots 41. As mentioned before, the beading 12 of the strip 11 is designed so that overflowing water will be directed away from the gutter. In particular, the beading 12 is provided with a surface 13 which extends outwardly with respect to the central longitudinal axis of the flexed strip 11 so as to direct the overflowing water away from the outer surface 15 of the flexed strip 11. If such beading was not provided, then water would tend to run along the outer surface 15 and would drip off the base of the flexed strip 11 thereby flowing onto the soffit panel 39.

Figure 4:
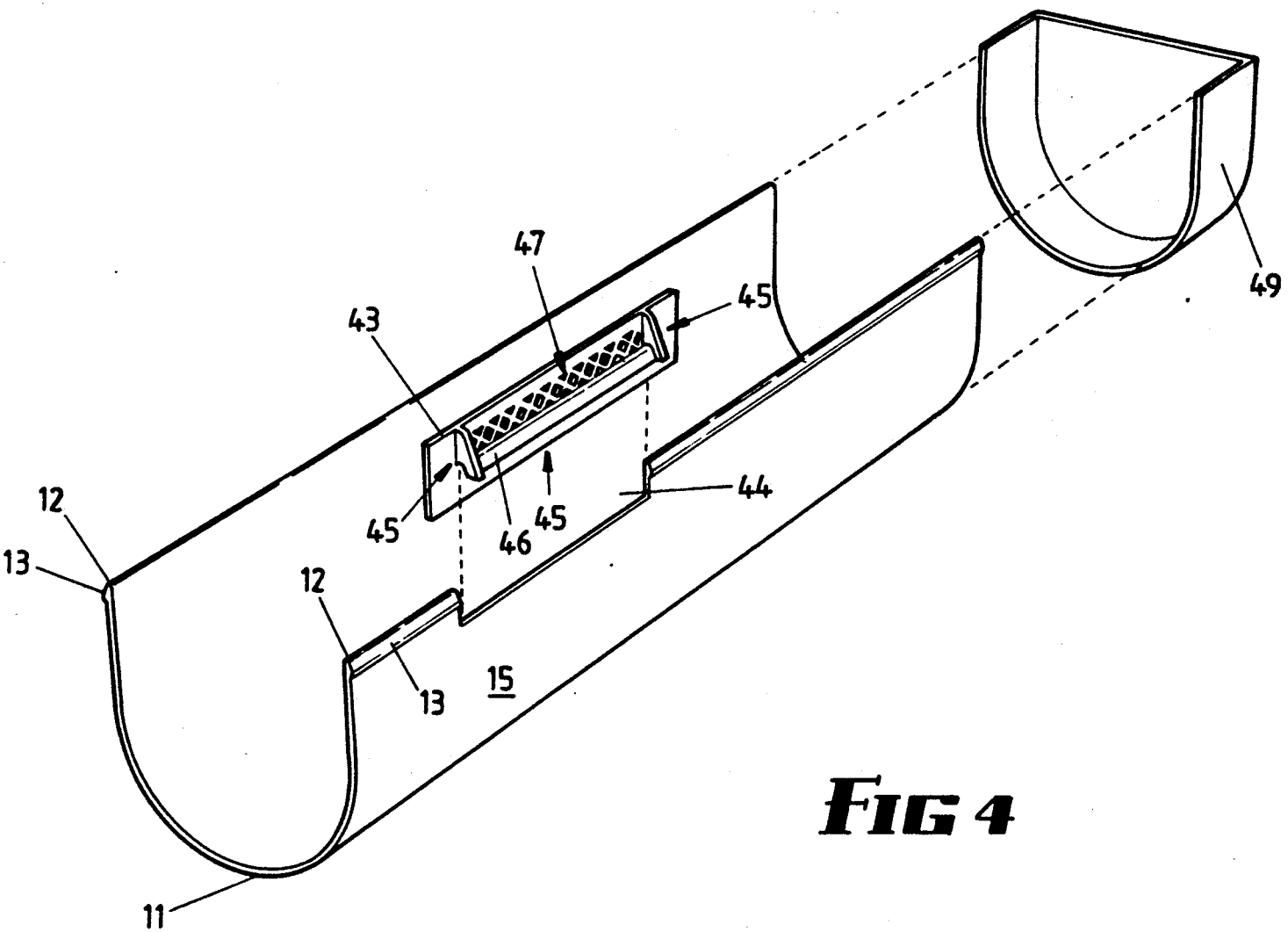
FIG. 4 shows a length of gutter with an overflow spout and an end cap.
Figure 5:
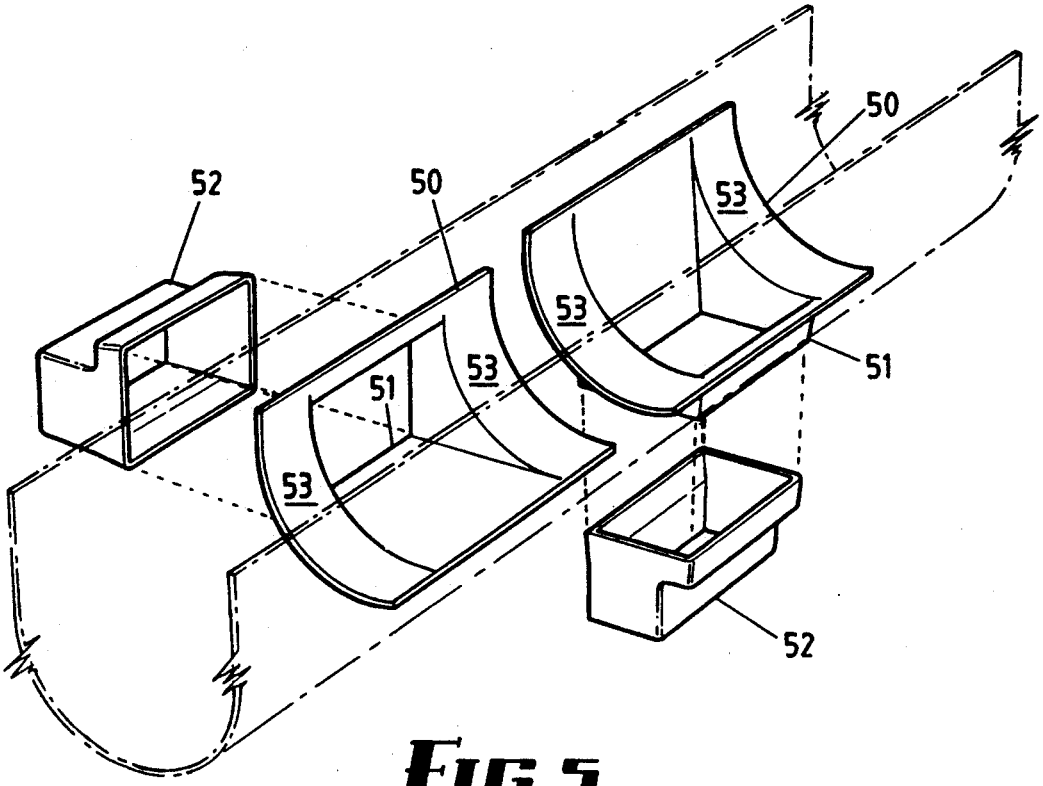
FIG. 5 shows a spigot section, and two methods of installation.

As seen in FIGS. 4, 5 and 6, various fittings are provided to enable installation of a complete gutter system, and to enable proper water flow through a gutter system installed around a house or structure.

FIG. 4 shows an overflow spout 43 which is fitted to the flexed strip 11 as shown in FIG. 4. A recess 44 is cut in the outer edge of the flexed strip 11, and surfaces 45 are glued to the inside surface of the flexed strip 11 such that the spout 46 extends through the recess 44. A perforate portion 47 allows outflow of water while preventing solid matter and other debris from flowing out of the gutter 10. This prevents the debris from collecting within the fascia panel 33. Again, the spout 46 is designed to direct water flow away from the outer surface 15 of the flexed strip 11 so as to ensure drainage occurring through the aperture 41 and to prevent water from entering the eaves and contacting the soffit panel 39.

FIG. 4 also shows an end cap 49 which is used to close off an free end of a flexed strip 11. The end cap 49 is pushed onto the end of the gutter, and solvent welded in place.

FIG. 5 shows a downpipe connector 50 which can be fixed to the outer surface 15 of the flexed strip 11 to provide drainage from the gutter 10. The downpipe connector 50 is provided with a spigot 51 to which an adaptor 52 connects which, in turn, allows connection to a conventional downpipe tube. As seen in FIG. 4, the downpipe 50 may be positioned onto the flexed strip 11 in one of two ways so as to result in a spigot exiting the gutter vertically, or horizontally. The downpipe connector is provided with surfaces 53 which allow the downpipe 50 to be solvent welded to the outer surface of the flexed strip 11. In order to complete installation of the downpipe connector 50, an aperture is cut into the flexed strip 11 allowing water flow through the spigot 51.

FIG. 6 shows a right-angled connector 54 which allows solvent welding connection of flexed strip 11 to either side of the right-angled connector 54. As shown in FIG. 6, on one side of the right-angled connector 54, the flexed strip 11 is welded to the inside surface of the connector 54, and on the other side, the flexed strip 11 is welded to the outside surface of the connector 54. As shown in FIG. 6, water flow is from the right side of the connector 54 to the left, and the arrangement of the gutter minimises the tendency for water leakage through the joints formed.

Obviously, the right-angled connector 54 may be used in relation to both inside corners or outside corners on any roof installation.

FIG. 6 also shows a longitudinally flexible section 56 which may be secured between two sections of gutter 10. The flexible section has a corrugated portion 57 and the flexible section 56 is formed from sufficiently resilient material to allow compression and expansion with respect to the longitudinal axis of the gutter within the corrugated portion 57. As seen in FIG. 6, the flexible section 56 is solvent welded between two sections of flexed strip 11. As the strip 11 is manufactured from uPVC, thermal expansion and contraction will occur as a result in changes in ambient temperature. Therefore, the use of the flexible section 56 is essential to prevent warping of the gutter 10 or breaking of any joints.

A brief consideration of the above description will indicate that the invention provides a novel and convenient means of installing continuous lengths of gutter to a roof while minimizing wastage and construction time.

We claim:

1. A gutter formed from continuous strip-like material, comprising a continuously extruded thin strip of polymeric material, said strip formed by an extrusion process with a U-shaped cross-section and being resilient enough to allow said strip to be both flattened and wound onto a roll for storage prior to use, and flexed about its longitudinal axis into a U-shaped cross-section when unwound, and a plurality of spaced brackets each having a recess in which said flexed strip is supported and each having means for securing said flexed strip within said recess, said gutter being formed by cutting a required length of said strip, placing said cut length of strip over said brackets, flexing said cut strip so as to locate it within said recess of each said bracket, and securing said cut strip to each of said brackets, wherein the brackets are adapted for being secured to a structure, wherein said recess in the bracket is substantially U-shaped, and wherein the means for securing said flexed strip within the recess comprise means for securing each longitudinal edge of said flexed strip so that when the brackets are secured to said structure, a longitudinal inner edge of the flexed strip in relation to said structure is held in a position that is higher than an opposing outer longitudinal edge of the flexed strip, wherein said means for securing the flexed strip further comprises a first means for fixedly securing the inner edge of said flexed strip which is closest to said structure, and a second means for adjustably holding the outer edge of said flexed strip, said second means having a plurality of fixing points to allow the vertical position of the base of the flexed strip to be varied.

2. A gutter according to claim 1 wherein beading is formed along each longitudinal edge of said strip, said beading being shaped to have a surface which extends outwardly with respect to the central longitudinal axis of said flexed strip so as to direct any overflowing fluid away from the outer surface of said flexed strip.

3. A gutter according to claim 2 wherein said first means further comprises an arm extending into said recess which is dependent and spaced from the bracket, the inner edge of the flexed strip being located between the bracket and arm, and a tab projecting from the bracket, which is positioned between the bracket and said arm, said beading positioned in relation to the tab so as to resist withdrawal of the inner edge of the flexed strip by the tab locating under the beading.

4. A gutter according to either claim 1 or claim 2 wherein said second means further comprises an arm extending into said recess which is dependent and spaced from the bracket, the outer edge of the flexed strip being located between the bracket and arm, and a plurality of tabs projecting from the bracket, which are positioned between the bracket and said arm, said beading positioned in relation to the tabs so as to resist withdrawal of the outer edge of the flexed strip by the tab locating under the beading.

5. A gutter formed from continuous strip-like material, comprising a continuously extruded thin strip of polymeric material, said strip formed by an extrusion process with a U-shaped cross-section and being resilient enough to allow said strip to be both flattened and wound onto a roll for storage prior to use, and flexed about its longitudinal axis into a U-shaped cross-section when unwound, and a plurality of spaced brackets each having a recess in which said flexed strip is supported and each having means for securing said flexed strip within said recess, said gutter being formed by cutting a required length of said strip, placing said cut length of strip over said brackets, flexing said cut strip so as to locate it within said recess of each said bracket, and securing said cut strip to each of said brackets, wherein the brackets are adapted for being secured to a structure, the gutter further comprising an overflow portion formed in an outer edge of the flexed strip in relation to said structure when the brackets are secured to said structure, said overflow portion comprising a perforate section of said outer edge, and an elongate spout formed below the perforate section on an outer surface of the flexed strip to direct overflowing fluid away from the outer surface of the flexed strip.

6. A gutter formed from continuous strip-like material, comprising a continuously extruded thin strip of polymeric material, said strip formed by an extrusion process with a U-shaped cross-section and being resilient enough to allow said strip to be both flattened and wound onto a roll for storage prior to use, and flexed about its longitudinal axis into a U-shaped cross-section when unwound, and a plurality of spaced brackets each having a recess in which said flexed strip is supported and each having means for securing said flexed strip within said recess, said gutter being formed by cutting a required length of said strip, placing said cut length of strip over said brackets, flexing said cut strip so as to locate it within said recess of each said bracket, and securing said cut strip to each of said brackets, wherein a beading is formed along each longitudinal edge of said strip, said beading being shaped to have a surface which extends outwardly with respect to the central longitudinal axis of said flexed strip so as to direct any overflowing fluid away from the outer surface of said flexed strip.

* * * * *

UNITED STATES PATENT AND TRADEMARK OFFICE

CERTIFICATE OF CORRECTION

PATENT NO. : 5,327,689

DATED : July 12, 1994

INVENTOR(S) : JAMES M. JANSEN

It is certified that error appears in the above-identified patent and that said Letters Patent is hereby corrected as shown below:

Column 1, line 43, before "provides", insert --In one aspect, this invention--.

Column 2, line 23, change "closes" to closest--.

Signed and Sealed this

Eighteenth Day of October, 1994

Bruce Lehman

*Attest:*

BRUCE LEHMAN

*Attesting Officer*

*Commissioner of Patents and Trademarks*